United States Patent [19]

Galland et al.

[11] 4,015,950

[45] Apr. 5, 1977

[54] SURFACE TREATMENT PROCESS FOR STEELS AND ARTICLE

[75] Inventors: Jacques Galland; Dominique Boutard nee Gabillet, both of Antony; Jacques Chêne, Paris, all of France

[73] Assignee: Agence Nationale de Valorisation de la Recherche (ANVAR), Neuilly-sur-Siene, France

[22] Filed: Aug. 1, 1975

[21] Appl. No.: 601,045

[30] Foreign Application Priority Data

Aug. 14, 1974 France ..... 74.2829

[52] U.S. Cl. ..... 428/648; 427/289; 427/329; 427/12; 427/336; 426/433; 156/664; 204/129.1

[51] Int. Cl.[2] ..... C23C 1/04

[58] Field of Search ..... 427/433, 383, 376, 191, 427/192, 289; 156/3, 18; 29/196.4, 183.5, 196.1; 75/123 A

[56] References Cited

UNITED STATES PATENTS

| | | | |
|---|---|---|---|
| 3,174,917 | 3/1965 | Lesney et al. | 29/196.4 X |
| 3,260,580 | 7/1966 | Kamm et al. | 29/196.4 |
| 3,779,798 | 12/1973 | Clinton | 427/383 |
| 3,890,686 | 6/1975 | Caubet | 29/196.1 |

FOREIGN PATENTS OR APPLICATIONS

| | | | |
|---|---|---|---|
| 787,383 | 12/1957 | United Kingdom | 427/383 D |

*Primary Examiner*—Ralph S. Kendall
*Attorney, Agent, or Firm*—Larson, Taylor and Hinds

[57] ABSTRACT

A process for treating a steel surface, comprising the steps of immersing the surface in a bath of molten tin at a temperature and for a period of time suitable to cause a layer of tin containing diffused iron to adhere to the surface and, after removal of the surface from the bath, removing a surface layer in which iron and tin accord substantially with the formula of Fe $Sn_2$ so as to expose a layer in which iron and tin accord substantially to the formula Fe Sn.

34 Claims, 4 Drawing Figures

SURFACE TREATMENT PROCESS FOR STEELS AND ARTICLE

FIELD OF THE INVENTION

The invention relates to surface treatment processes for steels, of the sort which involve the immersion of steel slugs (pieces) in a bath of molten tin.

THE PRIOR ART

It is known that these processes result in the surface formation of complex layers containing iron and tin and also, in the case where the treated alloy additionally contains nickel and chromium, (the case of nickel-chrome steels) certain amounts of nickel and chromium which diffuse from the said alloy.

However, up to the present time it has not been known how to make use of the properties of these layers, in particular as regards the surface hardness. It was known that layers of FeSn and $FeSn_2$ were obtained but there had been no means of separating these layers.

SUMMARY OF THE INVENTION

The principal object of the invention is to treat the piece in such a way that a layer of FeSn preferably containing considerable amounts of one of the metals Ni, Cr or possibly magnesium incorporated therein is finally revealed on the surface of the treated piece.

It has in fact been found that the layer of FeSn especially where it contains amounts of at least one of the afore-mentioned addition metals incorporated therein has hardness and corrosion resistance characteristics better than those of the $FeSn_2$ layer.

According to the invention there is provided a process for treating a steel surface, comprising the steps of immersing the surface in a bath of molten tin at a temperature and for a period of time suitable to cause a layer of tin containing diffused iron to adhere to the surface and, after removal of the surface from the bath, removing a surface layer in which iron and tin accord substantially with the formula $FeSn_2$ so as to expose a layer in which iron and tin accord substantially with the formula FeSn.

Preferably the steel contains a metal selected from the group consisting of nickel and chromium and the FeSn layer contains a proportion of such metal.

As has been shown in practice, such a process enables a layer of FeSn having a very high degree of hardness of the order of 500 to 700 V (Vickers) and also good corrosion resistance properties to be obtained, even in the case of a combined friction and corrosion process, in other words in the case of moving parts in a corrosive medium. This is a new feature compared with known surface treatments, in which the increase in hardness and improvement in friction properties resulting therefrom often have as a counterpart a decrease in the corrosion resistance.

The said process can be applied either to nickel-chrome steels such as in particular the 18/10 austenitic type steels, in which case the nickel and chromium contributing to the remarkable qualities of the FeSn layer diffuse theretowards from the underlying steel, or to other steels such as carbon steels, in which case the nickel and/or chromium or any other addition metal are added to the tin bath and diffuse into the said layer from this bath.

Means which may be used to remove the poorer quality surface layer of $FeSn_2$ are for example machining or grinding, which leaves only the FeSn layer remaining, or a chemical or electrochemical descaling.

Chemical descaling employs, in particular, soaking in a nitric acid solution to which hexamethylenetetramine has been added.

Electrochemical scaling involves, for example, applying a constant or variable voltage to the piece in a 1N sulphuric acid bath or other bath.

Another embodiment of the invention consists in slowly cooling (for example 100°/hour) the pieces after they have been treated, which tends to prevent fissuration due to the difference in the coefficients of expansion of steel and the FeSn-type compound.

Apart from these features and embodiments, the invention also includes certain other provisions which are preferably used at the same time and which will be discussed in more detail hereinafter.

The invention will be better understood with the help of the following description and the accompanying drawings relating thereto, said description and drawings being given of course only by way of example.

DETAILED DESCRIPTION OF EMBODIMENTS

In accordance with the invention, and more especially in accordance with those methods of application and embodiments of its various parts which are preferred, a process is provided in general for treating a steel in a tin bath in order to obtain a very hard and corrosion-resistant surface, said process being carried out as follows or in a similar manner.

It is assumed first of all that the piece being treated is nickel-chrome stainless steel, for example an 18/10 type austenitic steel.

The piece is first of all descaled before the treatment in the molten tin bath.

This descaling is very important since it prevents any chromium oxide film remaining on the surface of the piece, which would oppose the diffusion of nickel and chromium into the tin, and this diffusion is essential for the correct operation of the process, as will be seen later. The said descaling is carried out for example in a suitable steel bath, in particular one containing hydrochloric acid. However, alkaline solutions, particularly those containing soda, may also be used.

When the piece has been descaled it is immersed in a bath containing molten tin and is kept therein for an appropriate period of time at temperatures of the order of 400° to 700° C.

The treatment time is in particular approximately 48 hours, preferably up to 100 hours, but these figures are in no way limiting. As regards the temperature, it is desirable that it should be sufficiently high but it should not exceed the value at which steels of this type begin to be sensitised with, as in known, the formation of chromium carbide. A temperature of the order of 500 to 600° C is particularly appropriate.

It should also be noted that at low temperatures the treatment has tendency to promote the formation of the compound $FeSn_2$, whereas, as we shall see, it is particularly the compound FeSn which is important.

It should finally be noted that the use of times and temperatures which are greater than those suggested above, in particular 96 hours at 650° C or above, favours the formation at the surface of the austenitic stainless steel of a ferrite phase which is able to improve the adherence and resistance of the FeSn type compound at the surface of the steel during friction. Such treatment conditions would therefore be of great value in the case of stabilised (particularly with molybdenum or titanium) austenitic stainless steels which do no exhibit the sensitisation phenomenon already mentioned.

Tests have been carried out, particularly on a nickel-chrome steel having the following composition:

| C | Si | Mn | S | P | Ni | Cr | Mo | Ti | V | Nb |
|---|---|---|---|---|---|---|---|---|---|---|
| 0.028 | 0.26 | 1.78 | 0.019 | 0.022 | 9.70 | 18.31 | 0.33 | none | 0.026 | 0.030 |

and the following results, given simply by way of example, were obtained.

Figure 1:
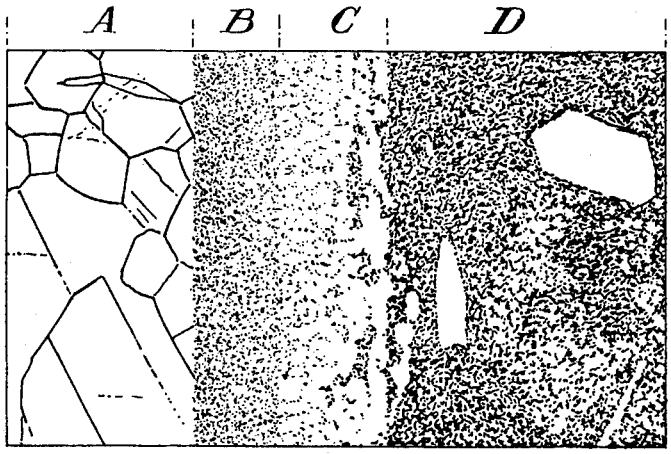
FIG. 1 shows diagrammatically (in a magnified section through the surface layers) the various layers obtained at the surface of a steel slug or piece treated by the process according to the invention.
Figure 2:
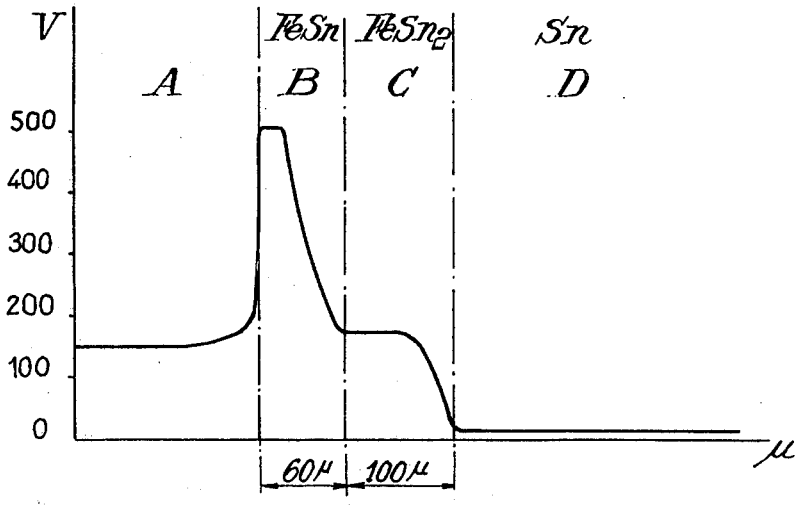
FIG. 2 is a diagram (corresponding to FIG. 1) showing the variation in the surface hardness in such a piece.
Figure 3:
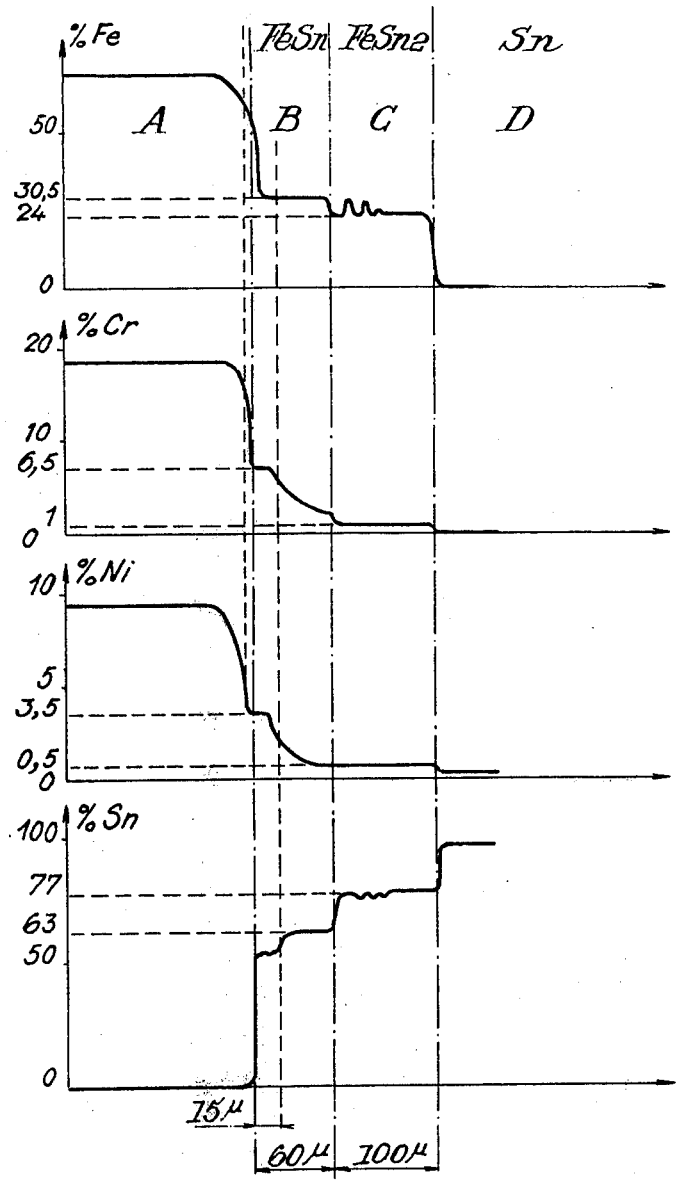
FIG. 3 is a diagram (corresponding to FIG. 1) showing the distribution of the constituents in the layers initially obtained.

After a treatment at 650° C for 48 hours, the following surface phases were obtained, as are also shown in FIGS. 1 to 3:

A. In the interior sub-layer the austenitic steel subjected to treatment has a hardness of the order of 150 V, as may be seen in FIG. 2, this layer apparently not having been sensitised by the treatment at 650° C, and the intergranular diffusion of tin into the austenitic structure appears to be very slight.

B. Above the previous phase is a layer of uniform appearance having a thickness of the order of 50 to 100 microns, particularly 50 to 70 microns, and a high degree of hardness, of the order of 450 to 500 V and even as high as 700–750 V, and analysis of this layer shows the presence of a relative amount of iron and tin corresponding to the specific compound FeSn, with in addition large amounts of chromium and nickel which have diffused from the base steel.

C. Next is a more extended phase having a thickness of the order of 100 microns, which is less compact than the preceding phase and has a lower degree of hardness, around 140 V, and whose composition corresponds in particular to a specific compound $FeSn_2$ with very small amounts of chromium and nickel (below 1%).

D. Finally there is a layer of tin with some polyhedric crystals of the $FeSn_2$ type.

The curves in FIG. 3 shown clearly the changes in the concentration of the alloy elements in the various phases.

In general a large decrease in nickel and chromium concentrations is found in the direction of the outermost layer of the treatment. It is also found however that the compounds of the FeSn and $FeSn_2$ type contain chromium and nickel. In actual fact it is the compound FeSn, situated at the boundary of the underlying steel, which contains most chromium and nickel, and this, it would appear, is present in the form of a specific compound of the type Fe(CrNiSn) in a layer of the order of 10 to 20 microns (the plateau of layer B, FIG. 2). The proportions of Ni and Cr in this layer, at least in the initial plateau region, may be of the order of 3 to 7% for chromium and 0.5 to 3.5% for nickel.

The presence of the said compound appears to increase the already high value of the hardness of the said layer B.

In addition, the fact that this layer B is still rich in chromium and nickel imparts good corrosion resistance properties.

The invention thus essentially consists of using a tin bath to obtain a surface layer B of the type Fe(Cr Ni Sn), and in addition removing a surface layer C of the type $FeSn_2$ of poorer quality.

This removal of the layer C may in particular be effected by machining, that is to say grinding the pieces to a sufficient depth so that the desired layer B appears. Other means of removal will be mentioned hereinafter.

As regards the hardness of the layer B which has thus been exposed, the considerable increase in hardness already mentioned above and which is seen in FIG. 2, is obtained. As regards the friction effect, which has been investigated under load using ceramic friction member, it has been found that the coefficient of friction is independent of the load beyond a limiting value of the latter, the said coefficient changing from 0.4 to about 0.25, that is to say being divided by a factor of one-and-a-half, for a hardness of the order of 500 V. In the case of metal friction members, the coefficient of friction was three times less than the value for the non-treated metal.

As regards the corrosion resistance, tests have been carried out in a 1N solution of sulphuric acid, and as a rule the tests included a study of the passivity curves.

It was found that although the value of the passivity current was slightly higher than in the case of untreated steels, it was nevertheless very low. It can be said that it remains 20 times lower than that obtained in the case of known treatment processes, such as sulpho-nitriding treatments.

The life of a steel treated according to the invention in a corrosive medium is thus much higher than that of a nitridated steel. The experimental values obtained indicate that the life of a tin diffusion treatment layer having a thickness of 100 microns is about 2 to 3 months in a 1N solution of sulphuric acid, whereas a sulpho-nitriding treatment layer of the same thickness will be destroyed after 3 or 4 days.

It should finally be said that these good corrosion resistance conditions remain, though to a less extent, even when friction and corrosion occur together.

Various other embodiments and preferred features will now be described.

According to one embodiment, at least one metal such as nickel and/or chromium, and even at least one other metal, in particular magnesium, is added to the molten tin bath.

Thus, a certain amount of nickel may be added to the tin bath, which may even be saturated with nickel, that is to say the amount of nickel may be greater than 6% by weight.

It is then found that not only does the amount of nickel diffusing into the compound FeSn increase, but also compounds of the type $Ni_3Sn_4$ are formed, which help to increase markedly the corrosion resistance.

This resistance appears to be three to four times higher than in the case where the nickel is merely allowed to diffuse from the piece assumed to be of nickel-chrome stainless steel. A reduction in the fragility is also noted, without the wear and tear resistance being affected.

The following procedure is adopted for the preparation of the tin bath saturated with nickel, taking into account the high melting point of the latter.

It is sufficient to add nickel (powder for example) to the liquid tin bath at 650° C. After keeping the bath at this temperature for a few hours, optionally combined with stirring of the bath, nickel is added to the bath to give a concentration of about 6%, any excess nickel remaining in the form in which it was added. This excess enables the nickel concentration in the tin bath to be maintained constant during treatment. This excess does not obstruct the operation in any way, on condition that it does not restrict contact between the surface to be treated and the bath.

The above method, consisting of incorporating an addition metal in the tin bath, may be applied to other addition metals.

Thus, magnesium may be added to the tin bath, in particular in an amount of 5 to 10%. On cooling it forms a compound of the type $Mg_2Sn$ which has the effect of improving the mechanical resistance of the tin-plated layers.

This method, consisting of incorporating additional metals in the tin bath, may be used in the treatment of steels other than nickel-chrome steels. In particular, it could be applied in the treatment of carbon steels in a tin bath. The additional metals of the bath, which would for example be nickel and chromium, will then diffuse into the FeSn layer or into the FeSn and $FeSn_2$ layers, thereby contributing to the improvement in the qualities of these layers, as in the case of the treatment of nickel-chrome steels.

This application is particularly important. In fact, if a carbon steel is merely treated in a tin bath a surface layer of FeSn is indeed obtained, but the corrosion resistance of this layer is 20 times less than that of the type Fe(CrNiSn) obtained by treating a nickel-chrome stainless steel in such a tin bath. If however in the treatment of a carbon steel, for example of the XC type, nickel and chromium are added to the tin bath, a layer of the type Fe(CrNiSn) is obtained, as in the case of the treatment of a stainless steel. However it should be noted that the concentrations of chromium and nickel are not necessarily identical to those mentioned in the case of the treatment of a stainless steel.

In each case it is in general important, as mentioned above, to remove the residual tin and the surface layer of $FeSn_2$ having less good qualities.

Instead of using a machining procedure for this purpose, in accordance with another provision of the invention there may be used a descaling operation in a bath, under conditions which enable the unreacted tin on the surface of the pieces to be recovered, and also enable the above-mentioned layer of $FeSn_2$ to be removed without however attacking the useful layer of FeSn.

Several solutions are possible to this problem of removing the first layer without causing any passivity of the second layer.

Very good results have been obtained by immersion in a concentrated solution of nitric acid (35% concentration, i.e. 10N), to which hexamethylenetetramine has been added in an amount of 1 g/liter.

At ambient temperature such a solution rapidly dissolves the tin and the $FeSn_2$ layer at a rate of 0.76/g Sn/h, i.e, in one hour a layer 1 mm thick per $1cm^2$ of surface area exposed to the solution is removed. The FeSn type compound is not attacked by this bath since it becomes passive spontaneously on contact with a concentrated solution of nitric acid. In addition, hexamethylene tetramine acts as a corrosion inhibitor for iron ions as soon as the compound appears on the surface. The rate of dissolution of the compound is nearly 150 times less than that of tin, i.e. is 0.0053 g/g compound/hour. It is even approximately six times less than that of the base stainless steel after the thermal treatment at 650° C for 48 hours. The use of such a bath thus promotes a rapid dissolution of the tin; the attack stops spontaneously as soon as the compound Fe(CrNiSn) appears on the surface.

In practice, after the pieces have been treated they are cleaned by simply immersing them in the bath in question. The removal of descaling products from the surface is accelerated by stirring the bath.

In order to prevent any possible escape of gases (always slight under these conditions), the descaling bath may be heated to a temperature slightly above the ambient temperature (30° to 40° C).

It is advantageous to recover the tin thus dissolved by the descaling bath.

In this connection it should be noted that the attack on the tin by such a bath basically leads to the formation of hydrated $\beta$ stannic oxide. This stannic oxide $SnO_2$ is insoluble in the solution and is thus easily recovered. In actual fact it constitutes the principal tin ore and can be reduced by one of the numerous known industrial or laboratory methods to obtain the metal.

Instead of using a descaling bath to remove the $FeSn_2$ layer, an electrochemical method may be used.

This method basically consists of applying to the surface or piece being descaled and immersed in an appropriate solution, a constant or variable voltage appropriate for the dissolution of tin, and for this several methods of operation may be considered.

According to a first method of operation a constant voltage is applied, appropriate for the dissolution of the tin and promoting the passivity of the compound Fe(CrNiSn) as soon as it appears at the surface.

Using a 1N solution of sulphuric acid, a potential of about −550 mV (with respect to a sulphate electrode) brings about a rapid dissolution of the tin without attacking the compound.

According to another method of operation, a potential which varies linearly according to an appropriate cycle, that is to say in an alternating manner, is applied to the surface being descaled.

For this purpose an automatically controlled potentiostat which provides the desired cycle is used. Thus, for a sulphuric acid solution such as mentioned above, the voltage may be varied in an alternating manner within a range of the order of −900 to +300 mV at a rate of several hundreds of mV per minute. Moreover, the potentiostat will be regulated to enable the dissolution of the tin and the removal of the descaling products to be controlled accurately.

Figure 4:
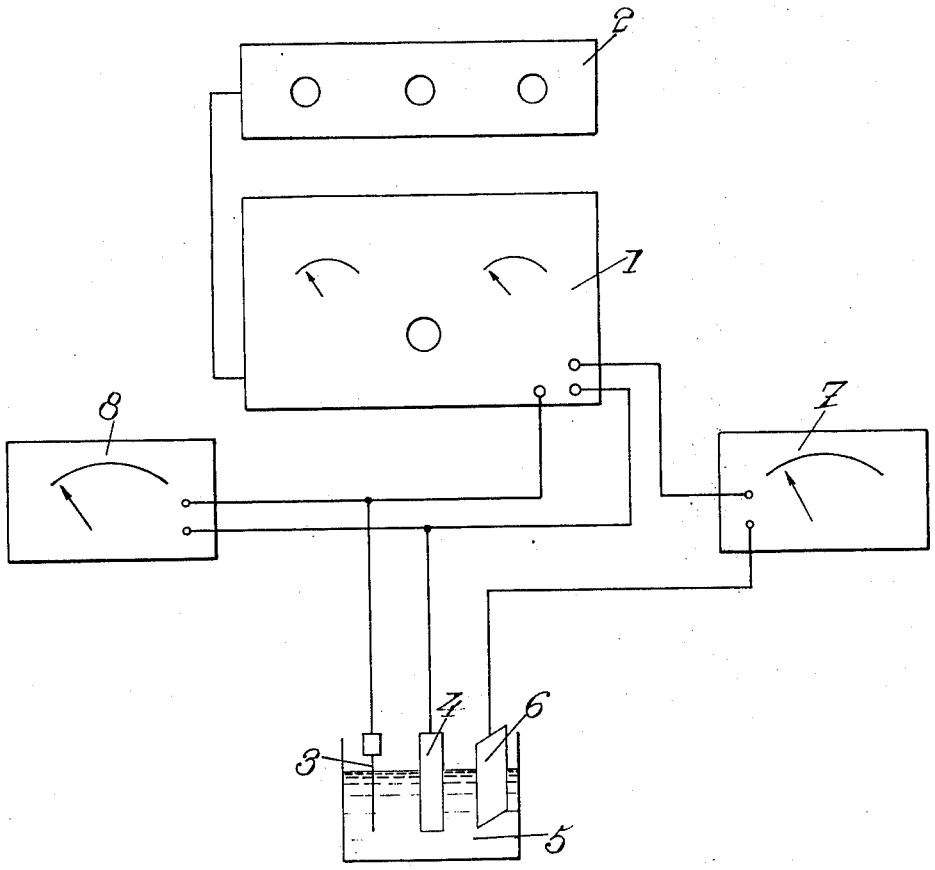
FIG. 4 shows an arrangement for the electrolytic descaling of the $FeSn_2$ layer, according to one of the embodiments of the invention.

FIG. 4 shows an arrangement which can be provided for such a descaling.

The voltage generator or potentiostat 1 is controlled by a pilot member 2. The generator applies a constant or variable voltage to the piece 4 to be descaled which is immersed in the solution 5, via a reference electrode 3 (a sulphate electrode for example). The resultant current which passes between the standard electrode 3 and a counter electrode 6 is measured by a milliammeter 7. The magnitude of the current defines the duration of the descaling operation. An electronic millivolt meter 8 regulates the voltage applied by the potentiostat 1 to the piece.

Whatever the method adopted, the electrochemical dissolution process will cease as soon as a very low passivity current density corresponding to the compound Fe(CrNiSn), i.e. about 0.1 $mA/cm^2$, appears.

The tin may advantageously be recovered from the descaling baths thus employed, and this may be effected by various methods, for example:

by directing reduction of the salts in an acid medium using reducing agents such as Zn, Al or Mg, by cathodic reduction after previous conversion, by hydrochloric acid, of stannic sulphate to stannic chloride.

In the latter case electrolysis of the stannic chloride is then carried out using a cathode, particularly a platinum cathode, on which the tin is deposited.

The final result of the above-specified methods of chemical or electrochemical descaling is to produce a metal surface containing practically only the compound of the type FeSn or Fe(CrNiSn). If necessary, that is to say in the case where the surface obtained is not absolutely in accordance with requirements from the mechanical point of view, the treated piece may be polished or lightly machined.

The invention also includes another preferred feature which enables cracks to be avoided, which can form in the surface of the piece after treatment in the tin bath as a result of differences which exist between the coefficients of expansion of steel and the compound FeSn. This arrangment consists in ensuring that the pieces are cooled slowly, for example in a furnace, at a rate of about 100° C per hour after they have been treated in the said bath.

Clearly, whichever embodiment is adopted steel pieces or slugs may be produced whose work surfaces may be substantially improved both as regards hardness or friction, and as regards corrosion resistance.

The treatment process is simple and is thus inexpensive.

In order to provide pieces according to a desired quota, the procedure may be carried out as for various known surface treatments, in this case taking into account the mechanical, chemical or electrochemical operations the piece must be subjected to in order to reveal the effective layer such as that designated hereinbefore by B.

It will be noted that, optionally, any stirring means can be provided to accelerate the reactions, and that in particular the pieces, if suitably supported, can be rotated or subjected to any other movements.

It goes without saying and furthermore also follows from what has already been said that the invention is not limited solely to those preferred embodiments which have been considered more particularly; on the contrary, it covers any other variations within the scope of the claims.

What is claimed is:

1. A method of providing a hard and corrosion resistant layer comprising iron and tin on a surface of a steel substrate which comprises: immersing a surface of a steel substrate in a bath of molten tin maintained at a temperature of from 400° to 700° C for a period of time sufficient to cause a tin-containing layer containing diffused iron to adhere to said surface, said tin-containing layer comprising a first, inner, portion adjacent the steel substrate containing iron and tin in amounts corresponding substantially to the formula FeSn, a second portion adjacent said first portion containing iron and steel in amounts corresponding substantially to the formula $FeSn_2$, and a third, outer, portion of tin adjacent said second portion; removing said surface bearing said tin-containing layer from said bath; and removing said third portion and said second portion of said tin-containing layer to provide said surface of said steel substrate with a hard and corrosion resistant layer containing iron and tin in amounts corresponding substantially to the formula FeSn.

2. A method according to claim 1 wherein said time is sufficient to provide a tin-containing layer having a thickness of about 100 to 200 microns.

3. A method according to claim 2 wherein the thickness of said first portion is about 50 to 100 microns.

4. A method according to claim 1 wherein said bath temperature is from 400° to 650° C.

5. A method according to claim 1 wherein said steel substrate contains a metal selected from the group consisting of nickel and chromium and wherein said hard and corrosion resistant layer contains said metal.

6. A method according to claim 5 wherein the amounts of nickel and chromium present in said hard and corrosion resistant layer are, respectively, about 0.5 to 3.5% by weight and about 3 to 7% by weight.

7. A method according to claim 1 wherein said bath of molten tin contains a metal selected from the group consisting of nickel, chromium and magnesium and wherein said hard and corrosion resistant layer contains said metal.

8. A method according to claim 7 wherein said bath of molten tin contains nickel in an amount of about 6% by weight.

9. A method according to claim 7 wherein said bath of molten tin contains magnesium in an amount of about 5 to 10% by weight.

10. A method according to claim 7 wherein said steel substrate is a carbon steel.

11. A method according to claim 1 wherein said steel substrate contains nickel and chromium and wherein said bath of molten tin contains nickel and chromium.

12. A method according to claim 1 wherein said period of time is about 48 to 100 hours.

13. A method according to claim 1 wherein said second and third portions of said tin-containing layer are removed by chemical descaling.

14. A method according to claim 13 wherein the surface is immersed in a descaling bath consisting essentially of a substantially 35% concentration nitric acid solution to which hexamethylenetetramine has been added.

15. A method according to claim 13 wherein the hexamethylenetetramine is added in an amount of about 1 g/liter.

16. A method according to claim 13 wherein tin is liberated during the descaling in the form of a precipitate of hydrated stannic oxide and wherein said tin is recovered.

17. A method according to claim 16 wherein the tin is recovered by direct reduction of salts in an acid medium using a reducing agent selected from the group consisting of Zn, Al and Mg.

18. A method according to claim 16 wherein the tin is recovered by cathodic reduction after a prior conversion, by hydrochloric acid, of stannic sulphate into stannic chloride.

19. A method according to claim 1 wherein the $FeSn_2$ layer is removed by chemical descaling.

20. A method according to claim 1 wherein said second and third portions of said tin-containing layer are removed by electrochemical descaling.

21. A method according to claim 20 wherein the descaling is carried out by immersing the surface in a substantially 1N sulphuric acid solution and applying a constant voltage (with respect to a sulphate electrode) of about −550 mV.

22. A method according to claim 21 wherein the voltage varies in an alternating manner over a range of the order of −900 to +300 mV, at a rate of a few hundreds of mV per minute.

23. A method according to claim 20 wherein the surface is immersed in a substantially 1N solution of sulphuric acid and a cyclically variable voltage (with respect to a sulphate electrode) is applied.

24. A method according to claim 20 wherein said steel substrate contains nickel and chromium and wherein electrochemical descaling is stopped when a very weak passivity current results from the appearance of the compound Fe(Cr Ni Sn).

25. A method according to claim 1 wherein after the immersion a slow cooling of the surface is carried out to prevent fissuration due to the difference in coefficients of expansion of steel and said tin-containing layer.

26. A method according to claim 1 wherein said second and third portions of said tin-containing layer are removed mechanically.

27. A method according to claim 26 wherein said second and third portions are removed by grinding.

28. A steel substrate having a surface bearing a hard and corrosion resistant layer having a thickness of about 50 to 100 microns, containing iron and tin in amounts corresponding substantially to the formula FeSn and being made according to the process of claim 1.

29. A steel substrate according to claim 28 wherein said hard and corrosion resistant layer contains a metal selected from the group consisting of Cr, Ni, and Mg.

30. A steel substrate according to claim 29 wherein said hard and corrosion resistant layer contains Cr and Ni.

31. A steel substrate according to claim 30 wherein said hard and corrosion resistant layer includes an inner region adjacent the surface of said steel substrate in which Cr and Ni are present in amounts, respectively, of 3 to 7% by weight and 0.5 to 3.5% by weight.

32. A steel substrate according to claim 31 wherein said region has a thickness of about 10–20 microns.

33. A steel substrate according to claim 28 wherein said hard and corrosion resistant layer has a hardness of from 400 to 750 Vickers.

34. A steel substrate having a surface bearing a hard and corrosion resistant layer having a thickness of about 50 to 100 microns, and containing iron and tin in amounts corresponding substantially to the formula FeSn.

* * * * *